US007798042B2

(12) United States Patent
Stein

(10) Patent No.: US 7,798,042 B2
(45) Date of Patent: Sep. 21, 2010

(54) RECIPROCATED KNIFE HAVING AN INTEGRAL TANGENT AXIS ORIENTATION DRIVE

(75) Inventor: Darryl C. Stein, Andover, CT (US)

(73) Assignee: Gerber Scientific International, Inc., South Windsor, CT (US)

( * ) Notice: Subject to any disclaimer, the term of this patent is extended or adjusted under 35 U.S.C. 154(b) by 524 days.

(21) Appl. No.: 11/382,242

(22) Filed: May 8, 2006

(65) Prior Publication Data

US 2007/0256530 A1 Nov. 8, 2007

(51) Int. Cl.
*B26D 1/10* (2006.01)
*B26D 5/08* (2006.01)

(52) U.S. Cl. ..... 83/747; 83/635; 83/940

(58) Field of Classification Search ..... 83/747, 83/936, 940, 575, 635, 697
See application file for complete search history.

(56) References Cited

U.S. PATENT DOCUMENTS

| | | | | |
|---|---|---|---|---|
| 2,624,115 | A | 1/1953 | Gallagher et al. | |
| 3,747,454 | A * | 7/1973 | Gerber | 83/747 |
| 4,048,891 | A * | 9/1977 | Pearl | 83/936 |
| 4,653,362 | A * | 3/1987 | Gerber | 83/16 |
| 4,762,040 | A * | 8/1988 | Alcantara Perez et al. | 83/940 |
| 5,040,442 | A * | 8/1991 | Nasu | 83/747 |
| 5,090,284 | A * | 2/1992 | Nakajima | 83/577 |
| 5,113,736 | A * | 5/1992 | Meyerle | 83/575 |
| 5,269,213 | A * | 12/1993 | Coneski et al. | 83/577 |
| 5,573,442 | A * | 11/1996 | Morita et al. | 451/8 |
| 5,687,629 | A * | 11/1997 | Galan et al. | 83/747 |
| 6,000,310 | A * | 12/1999 | Shilkrut et al. | 83/615 |
| 6,003,481 | A | 12/1999 | Pischinger et al. | |
| 6,484,613 | B1 * | 11/2002 | Lee et al. | 83/13 |
| 7,011,007 | B2 * | 3/2006 | Stein | 83/940 |
| 7,404,348 | B2 * | 7/2008 | Dietz et al. | 83/581 |

FOREIGN PATENT DOCUMENTS

| | | |
|---|---|---|
| EP | 0679482 A1 | 11/1995 |
| EP | 0679483 B1 | 12/1997 |

OTHER PUBLICATIONS

International Search Report of Jul. 2, 2007 for PCT/US06/18005 ( mailing date of ISR Sep. 24, 2007).

* cited by examiner

*Primary Examiner*—Stephen Choi
(74) *Attorney, Agent, or Firm*—Crowell & Moring LLP

(57) ABSTRACT

A reciprocated knife cuts pattern work material pieces without rotating a housing tube for orientation of the cutting knife. An integrated tangent axis drive motor orients the cutting knife, eliminating any inertia caused by the cutting housing tube and preventing the slowing of the angular acceleration and increasing the speed of the knife orientation. Alternative motor types are provided by various embodiments of the invention.

20 Claims, 9 Drawing Sheets

RECIPROCATED KNIFE HAVING AN INTEGRAL TANGENT AXIS ORIENTATION DRIVE

FIELD OF INVENTION

The present invention is generally directed to cutting shapes from sheet type work material and is more specifically related to cutting shapes using a computer controlled cutting table incorporating a reciprocated knife having a tangent axis orientation drive.

BACKGROUND OF THE INVENTION

Historically, a computer controlled cutting table incorporating a motor reciprocated knife has been used to cut a single-ply of flexible sheet type material, such as leather. For example, Zund Systemtechnik of Altstatten, Switzerland produces a motor reciprocated knife. A typical example of this type of cutting apparatus is schematically illustrated in FIG. 1.

In this example, a computer controlled tangent axis drive motor 1000 is coupled to a housing tube 1010 that is keyed to the reciprocating knife 1020. Therefore, any movement of the housing tube generates movement of the knife. The knife is oriented tangent to the cut path by rotating the housing tube via the tangent axis motor drive.

A limitation of the existing art is that the inertia of the housing tube is oriented along with the knife. This extra inertia may slow the angular acceleration of orientation of the knife. To maximize the throughput of cut pieces, it is desirable to orient the knife as quickly as possible.

Another difficulty occurs when multiple changes in the cutting direction of the knife is required at very short time intervals. A series of changes of cutting direction can decrease the quality of the final cut sheet by having the cutting knife's orientation hampered by the inertia of the housing tube. The use of the housing tube to orient the cutting knife can greatly and detrimentally affect the amount of time it takes to cut a pattern piece from the work material. In addition, because of the need for multiple changes in cutting knife direction, the likelihood for errors can increase at higher throughput speeds.

Based on the foregoing, there is a need in the art to provide a cutting apparatus that improves upon or overcomes the drawbacks of prior art devices.

SUMMARY OF THE INVENTION

The present invention is directed in one aspect to an apparatus for cutting pattern pieces that eliminates the rotating housing tube, and consequently increases the speed of knife orientation. The invention is not limited to motor reciprocation. Other means of reciprocating the knife are possible, including but not limited to, a mass-spring system that is excited by an electromagnetic actuator.

In one embodiment of the present invention, a servomotor orients the heading of the knife in response to a controller. The reciprocating motion of the knife is performed by a second motor that causes rotational motion of a spool. The spool is coupled to a rod. A bushing at the end of the rod allows rotary and linear motion to the knife also at the distal end of the rod.

In another embodiment of the invention, the motor that reciprocates the knife has a crack shaft with an eccentric shaft connected to ball bearings disposed in the spool. A pressure distributor may be attached to the ball bearing to reduce contact stresses of the flanges of the spool.

In another form of the invention the servomotor and secondary motor are attached to a housing. The distal end of the housing has threading mated with a presser foot that is used to provide adjustment of the cutting depth of the knife. A spring loaded catch can be used to prevent the presser foot from rotating and changing the cutting depth during the cutting operation.

The present invention can be utilized in, but is not limited to, a mass-spring system implementation. In this embodiment, a servomotor orients the knife tangent to a cutting path. The servomotor can be an encoder, but is not limited to this implementation. The mass spring motion is produced by an electromagnetic actuator.

An advantage of the present invention is that the process of cutting can be performed quickly and automatically.

These aspects and other objects, features and advantages of the invention are described in the following Detailed Description, which is to be read in conjunction with the accompanying drawings.

DETAILED DESCRIPTION

Figure 1:
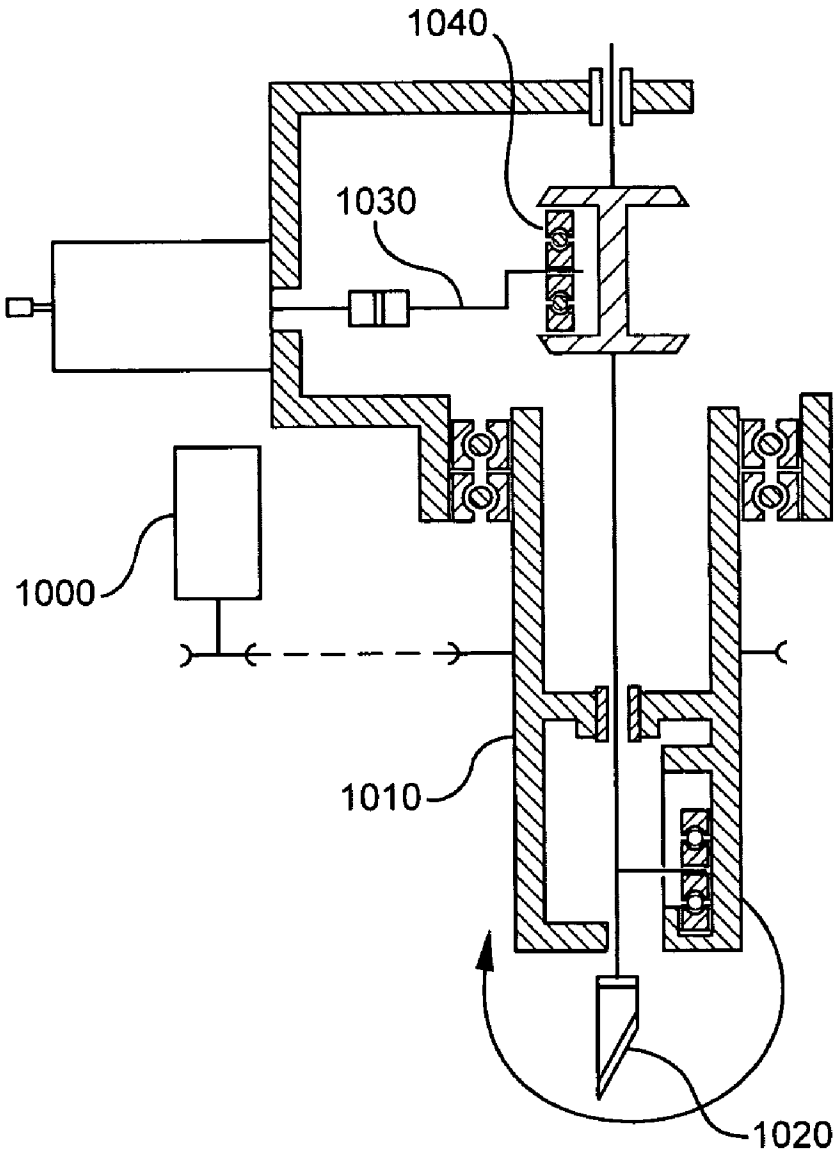
FIG. 1 (Prior Art)
FIG. 1 is a schematic view of a cutting apparatus known in the art.

FIG. 1 illustrates a cutting apparatus known in the art. A motor driven crank arm 1030 generates the reciprocation motion. At the end of the crank arm is a ball bearing whose outer race is captured between flanges of a spool. The spool motion is linear and is guided by linear ball bearings 1040 at each end. A computer controlled tangent axis drive motor 1000 is coupled to a housing tube 1010. The housing tube is keyed to a reciprocating knife 1020 such that it may be oriented tangent to cut a path through work material. One limitation of this existing apparatus is that the inertia of the housing tube is oriented along with the knife. The extra inertia may slow the angular acceleration of the knife's orientation.

The present invention eliminates the need of a rotating housing tube and consequently increases the speed of knife orientation. Again, the present invention is not limited to driving the knife through a reciprocation drive motor. Other means of reciprocating the knife are possible, such as, but not limited to, a mass spring system that is excited by an electromagnetic actuator.

Figure 2:
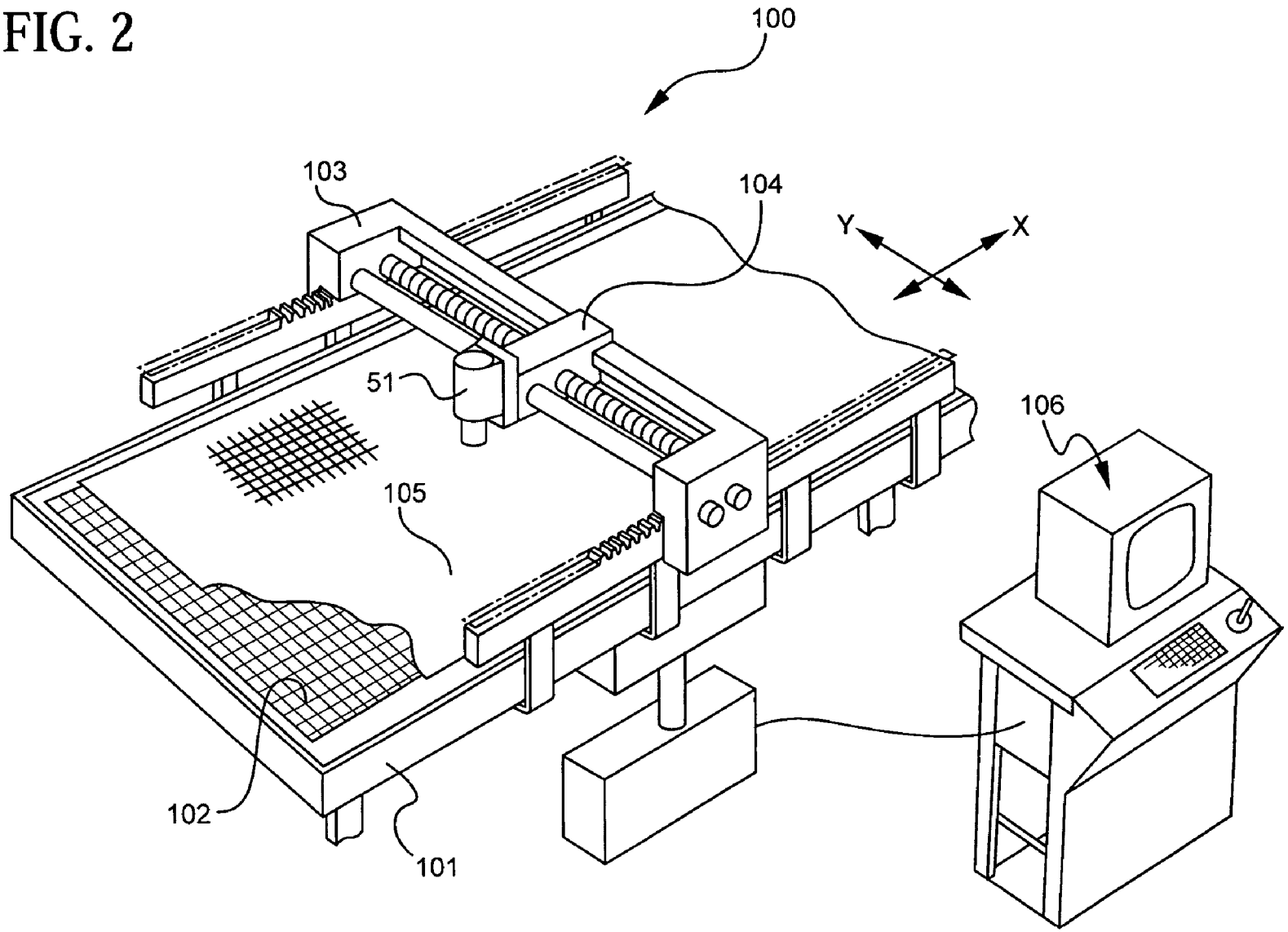
FIG. 2 is a perspective illustration of a cutting table incorporating the present invention.

Shown in FIG. 2 is a cutting table generally designated by the reference number 100. The table includes a frame 101 and a work material support surface 102 adapted to carry at least one layer of sheet-type work material 105. The work material includes, but is not limited to, leather or vinyl thereon. A beam 103 is coupled to the frame for movement back-and-forth in a first direction as indicated by the arrows labeled "X." A carriage 104 is mounted to the beam 103 and is movable back-and-forth along a second direction as indicated by the arrows labeled "Y." A tool head 51 is mounted to the carriage and moves in the directions "X" and "Y" in response to commands issued from a controller 106.

Figure 3:
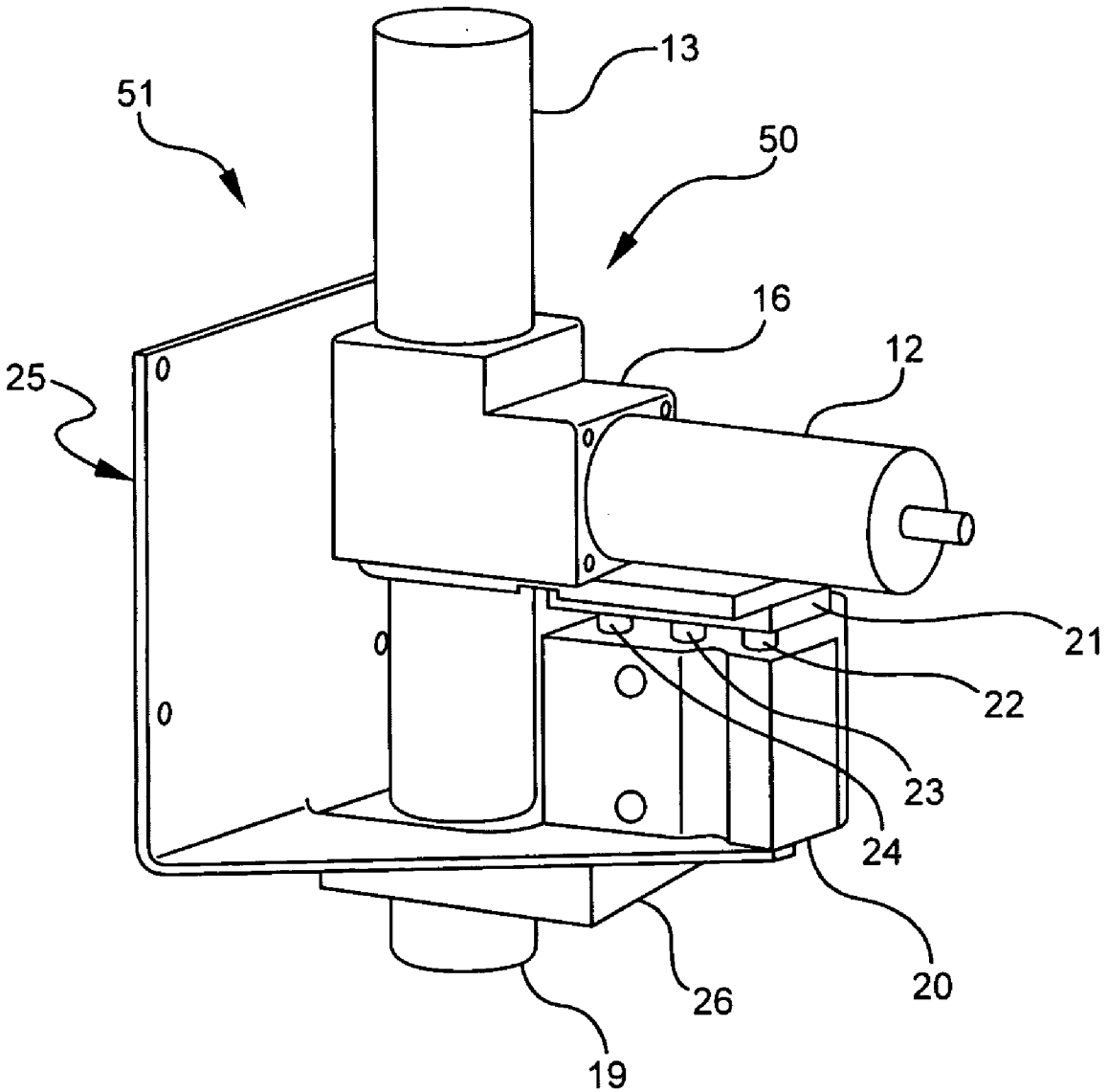
FIG. 3 is a perspective view showing one embodiment of the invention.

FIG. 3 illustrates one embodiment of the tool head 51, which includes a main support bracket 25, a power tool generally designated 50, and a guided pneumatic cylinder designated by reference numerals 20, 21, 22, 23, and 24, which in response to commands issued by the controller 106, engages and disengages the power tool 50 with the work material 105. A bushing block 26 guides and supports the knife end of the power tool 50.

Figure 4:
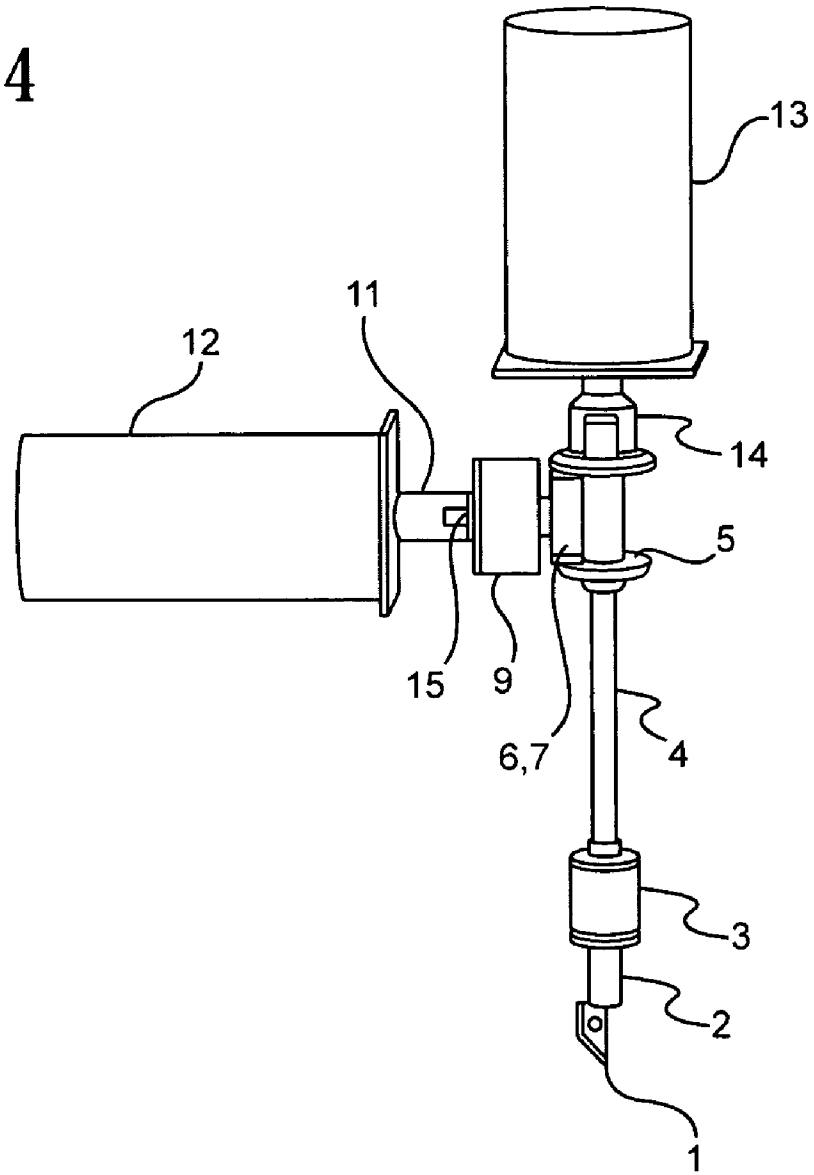
FIG. 4 is a partial view showing internals of one embodiment of the present invention.
Figure 5:
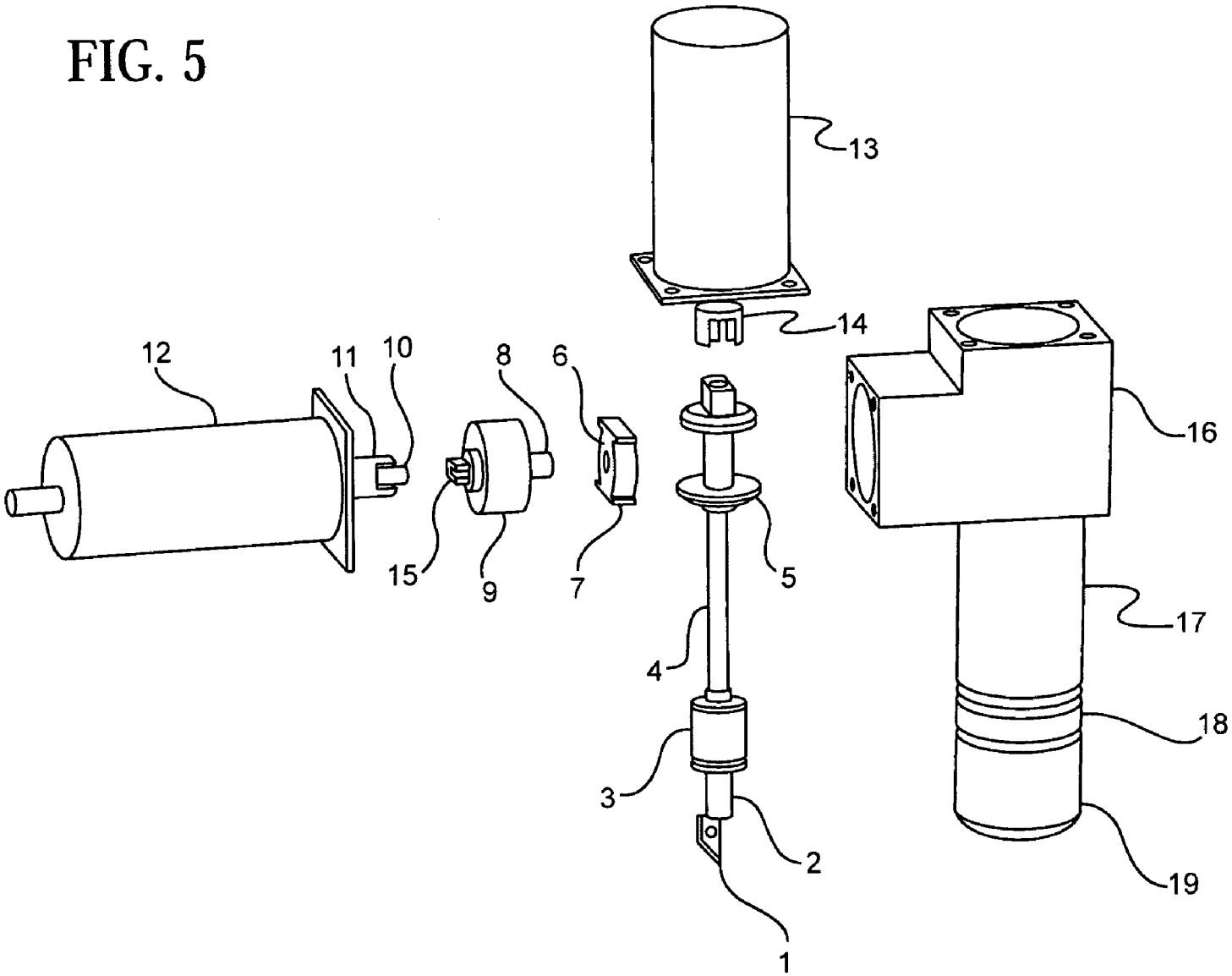
FIG. 5 is an exploded view showing portions of the internals of the embodiment of FIG. 4.

Illustrated in FIGS. 4 and 5 are the internals of one embodiment of the power tool 50. A knife I is held in a tool holder 2. A rod 4 connects the tool holder 2 to a spool 5. A bushing 3 permits rotary and linear motion and supports the knife end of the rod 4. A servomotor 13 orients the heading of the knife 1 in response to commands issued from the controller.

As shown in FIG. 5, a crankshaft 15 has an eccentric end 8 onto which the ball bearing 6 is press fit. A motor 12 is attached to a second coupling 11 that drives the first bearing 6 in an orbit between the flanges of the spool 5. The second coupling has a head 10 to assist in connection. The orbit motions cause the spool 5 to reciprocate in a linear motion. In turn the knife 1 reciprocates.

Further shown in FIG. 5, the servomotor 13 and the motor 12 can be attached to a housing 16. The outer race of the double row ball bearing 9 fits into a round pocket in the housing 16, and is secured by an internal retaining ring. A tube 17 leads away from the housing 16. The remote end of the housing tube has external thread onto which is screwed a presser foot 19. The threads provide a means of adjusting the maximum cutting depth. A spring-loaded catch 18 prevents the presser foot from rotating during cutting operation. It is apparent that other means known by those skilled in the art can be utilized to adjust the height of the cutting knife and secure the adjustment. The above are examples and are not mentioned to limit the invention to these particular embodiments.

Figure 7:
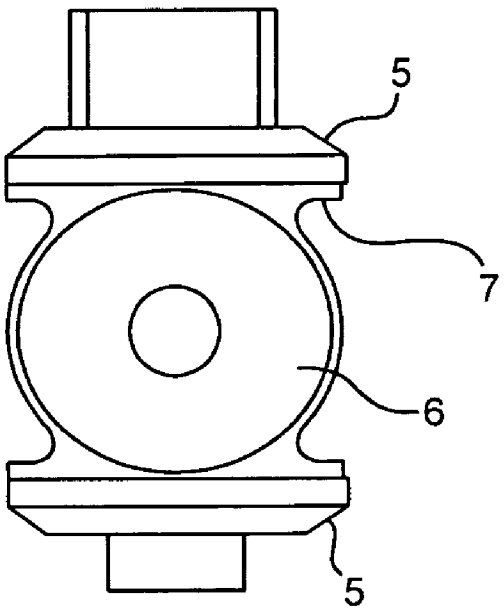
FIG. 7 is an enlarged view showing the ball bearing of FIG. 6 with a pressure distributor for reducing contact stress in the spool.
Figure 6:
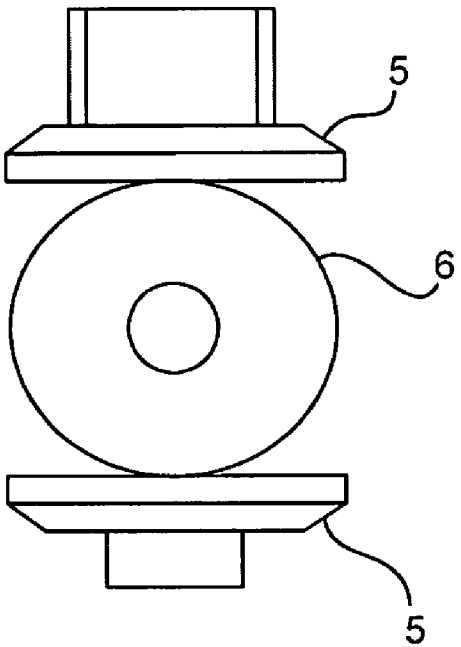
FIG. 6 is an enlarged view showing a ball bearing in a spool for converting rotary motion to linear motion.

FIG. 6 illustrates ball bearing 6 being constrained between the flanges of the spool 5. Shown in FIG. 7, a pressure distributor 7 may be attached to the outer race of the ball bearing 6. This reduces the contact stresses on the flanges of the spool 5.

Figure 8:
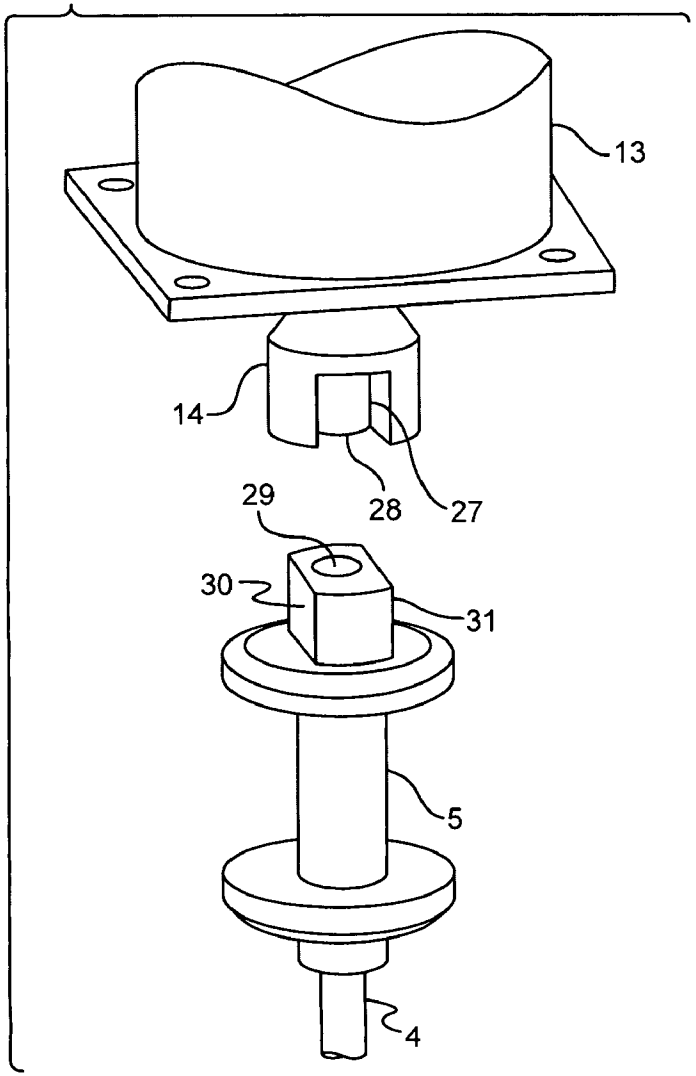
FIG. 8 is an enlarged partial perspective view showing a coupling for a tangent axis drive motor.

Shown in FIG. 8, the servomotor 13 has an output shaft 28 that is attached a first coupling 14. The output shaft passes through a slot 27 in the first coupling 14. The spool 5 has a hole feature 29, a first flat 30, a second flat 31 that mate with the slot 27 of the first coupling 14. Depending on the embodiment, the spool 5 is fabricated from, but not limited to, Teflon® (tetrafluroethyene) filled acetal. The first coupling 14 depending on the embodiment is made from, but not limited to, stainless steel.

Figure 9:
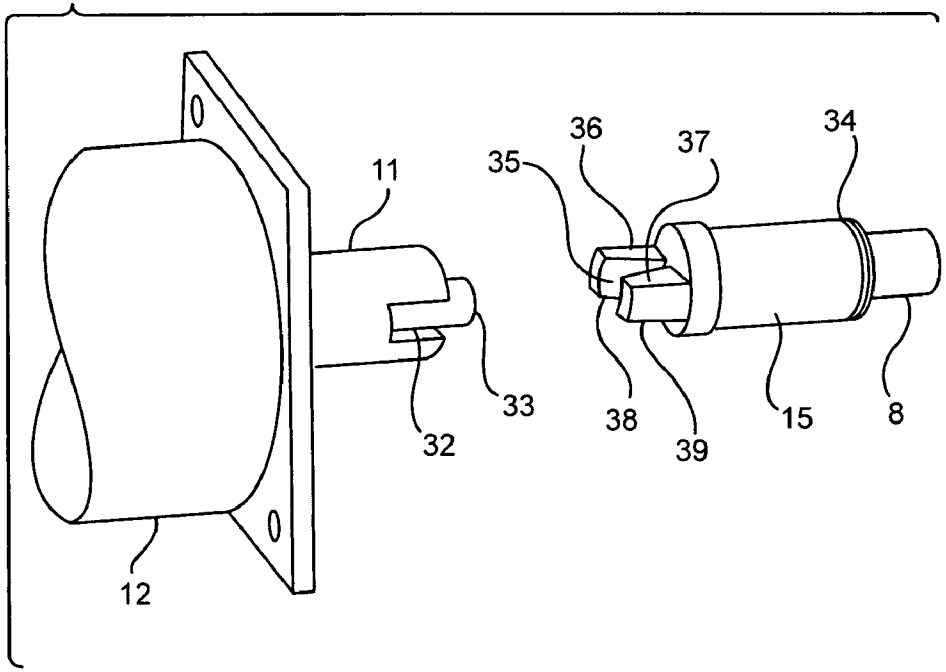
FIG. 9 is an enlarged partial perspective view showing a coupling for a reciprocation drive motor.

As shown in FIG. 9 the second coupling 11 has a slot, through which passes the shaft 33 of the motor 12. The crankshaft 15 has a hole feature 35 and a plurality of flats 36, 37, 38 and 39. These flats mate with the slot 32 of the second coupling 11 and the shaft 33. The crankshaft 15 is supported by a double row ball bearing 9 shown in FIG. 5 that is retained by an external retaining ring that is placed in a groove feature 34 of the crankshaft 15.

Figure 10:
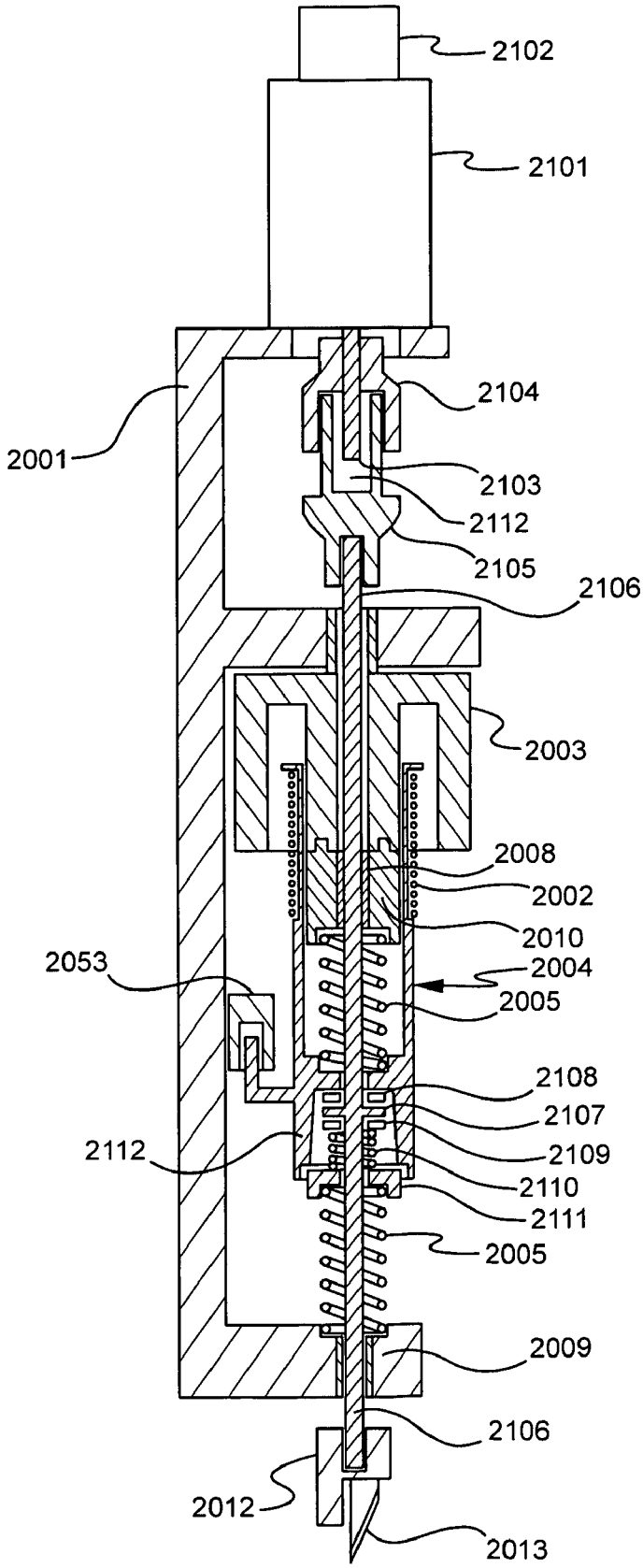
FIG. 10 is the present invention having a blade that is reciprocated by a mass spring system that has motion provided by an electromagnetic actuator.

FIG. 10 shows an embodiment of the power tool 50 where a mass-spring system is utilized and powered by an electromagnetic actuator. In this embodiment, the electromagnetic actuator replaces the reciprocating drive motor. Similar to the embodiment of FIG. 4, a servomotor 2101 orients a knife 2013 tangent to the cut path. Attached to the servomotor 2101 is an encoder 2102 or other means of angular shaft position feedback. Rod 2106 is slidably coupled to move relative to housing 2001. A first linear bearing 2008 and a second linear bearing 2009 are included to provide a means of sliding contact for rod 2106. A transducer 2053 provides feedback of the motion of knife 2013. Depending on the implementation, the knife 2013 is secured to a knife holder 2012 that is coupled to rod 2106. A voice coil actuator that comprises of a coil 2002 and a magnetic field assembly 2003 provides excitation or actuation of the mass spring system. The first linear bearing 2008 is disposed in a bearing support 2010 that is attached to magnetic field assembly 2003. A first spring 2005 and a second spring 2006 provide elastic elements of the dynamic system.

Figure 11:
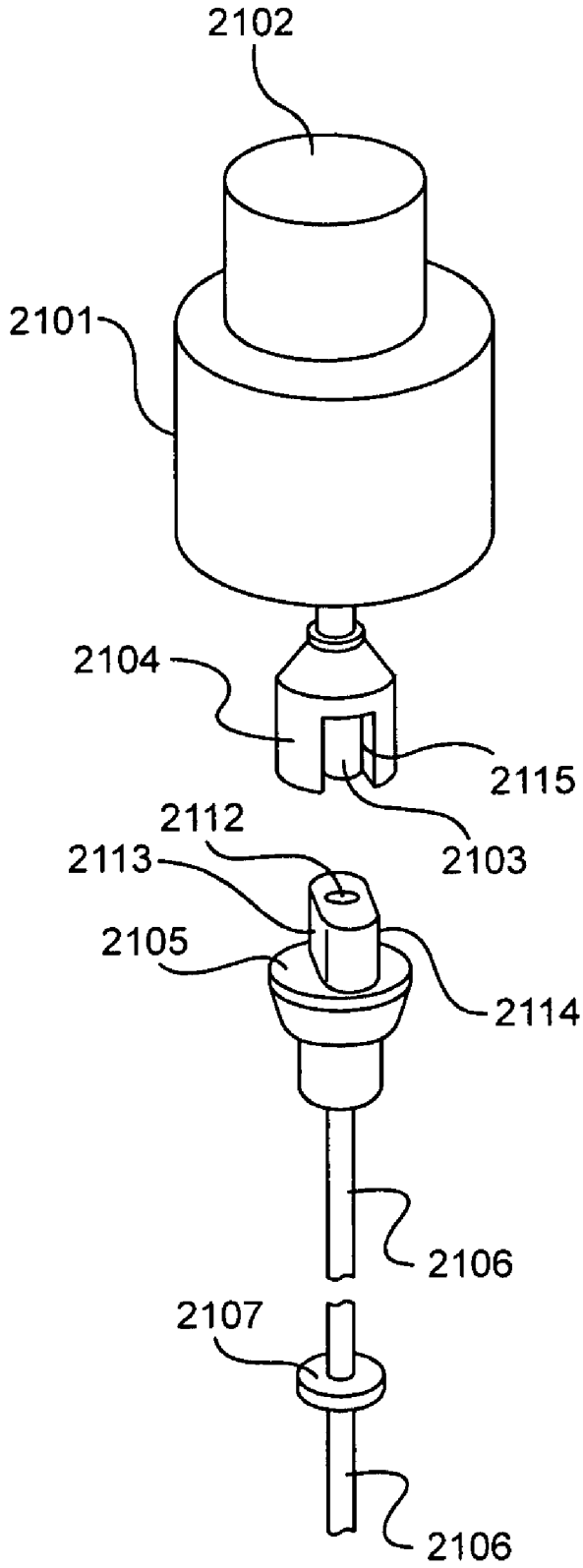
FIG. 11 is a partial perspective view showing portions of the embodiment of FIG. 10.

FIG. 11 is an enlarged partial view showing portions of the embodiment of FIG. 10. The servomotor has an output shaft 2103 to which is attached a first hub 2104. The first hub 2104 has a slot 2115, and into the space formed by the slot 2115 the output shaft passes. The first hub 2104 mates with a second hub 2105, that has a first flat surface 2113, a second flat surface 2114, and a hole 2112 whose diameter is a location-clearance fit to the output shaft 2103. A rod 2106 is attached to the second hub 2105. The first hub 2104 and the second hub 2105 form a coupling that allows translation while stopping rotation of the rod 2106 relative to the output shaft 2103. Material choices for the hubs, include but are not limited to, materials that accommodate the relative sliding motion. For example, the first hub 2104 may be fabricated of stainless steel, and the second hub 2105 of tetrafluroethylene filled acetal. Those skilled in the art will recognize other ways to make couplings that allow translation while stopping rotation, as well as other material from which to fabricate them.

A cupped spool 2004 has a cup feature 2112 that radially captures a flange feature 2107 of the rod 2106. A first thrust bearing 2108, a second thrust bearing 2109, a third spring 2110, and a cup washer 2111 capture the flange feature 2107 axially. With this arrangement, the rod 2106 is free to rotate, but cannot translate relative to the cupped spool 2004. The first thrust bearing 2108, a second thrust bearing 2109 may be fabricated from, for example, plastic suitable for bearing applications. Thrust washers of sintered bronze impregnated with oil are another example of a substitute. As with the other embodiment described in FIG. 4, the servomotor 2101 orients the knife 2013.

It should be understood that the above description is only representative of illustrative examples of embodiments. For the reader's convenience, the above description has focused on a representative sample of possible embodiments, a sample that teaches the principles of the invention. The description has not attempted to exhaustively enumerate all possible variations.

Therefore, the embodiments described herein are examples only, as other variations are within the scope of the invention as defined by the appended claims.

What is claimed is:

1. An apparatus for cutting a sheet-type work material having a power tool, the power tool comprising:

a cutting knife disposed in a tool holder;

a rod having a distal end and proximal end, and a spool;

the proximal end being attached to the spool, and the distal end being attached to the tool holder;

a tool housing enclosing at least a portion of the rod;

a bushing disposed between the knife and the spool for permitting rotary and linear motion of the knife;

means for providing reciprocating motion to the knife for cutting; and a tangential axis drive motor having a drive shaft, a longitudinal axis of said shaft coaxially attached to the spool for orientating the direction of the knife in response to commands issued from a controller by rotating the rod relative to the tool housing.

2. An apparatus as defined by claim 1, wherein the reciprocating motion means is a motor.

3. An apparatus as defined by claim 2, wherein the motor is coupled to the spool by a crank shaft.

4. An apparatus as defined by claim 3, wherein the spool has flanges and the crank shaft has an eccentric end coupled to at least one ball bearing disposed between the flanges of the spool to cause orbital motion to reciprocate the knife.

5. An apparatus as defined by claim 4, wherein the ball bearing further includes a pressure distributor to reduce contact stresses in the flanges.

6. An apparatus as defined by claim 1, wherein the reciprocating motion means is a mass spring system actuated by an electromagnetic actuator.

7. An apparatus as defined by claim 1, wherein the tangential axis drive motor is a servomotor.

8. An apparatus as defined by claim 1, wherein the tangential axis drive motor and the reciprocating motion means are attached to a housing having a means for adjusting the cutting depth of the knife.

9. An apparatus as defined by claim 8, further comprising a means for securing the height adjustment of the cutting knife.

10. An apparatus as defined in claim 9, wherein the securing means is a spring loaded catch and the height adjustment means is external thread on the housing mated with a screwed presser foot.

11. An apparatus for cutting for cutting a sheet-type work material, comprising:

a support surface mounted on a frame for carrying at least one layer of sheet-type work material thereon;

a carriage coupled to the frame for movement in various directions in response to commands issued from a controller;

a tool head mounted to the carriage and having a power tool and a guided pneumatic cylinder cutting head, the tool head being movable in various directions in response to commands from the controller, the power tool being able to engage and disengage with the work material in response to commands from the controller;

a cutting knife disposed in a tool holder;

a rod having a distal end and proximal end, and a spool;

the proximal end being attached to the spool, and the distal end being attached to the tool holder;

a bushing disposed between the knife and the spool for permitting rotary and linear motion of the knife;

means for providing reciprocating motion to the knife for cutting; and a tangential axis drive motor having a drive shaft, a longitudinal axis of said shaft coaxially attached to the spool for orientating the direction of the knife in response to commands issued from a controller.

12. An apparatus as defined by claim 11, wherein the means for providing reciprocating motion is a reciprocating drive motor.

13. An apparatus as defined by claim 11, wherein the means for providing reciprocating motion is a mass spring system actuated by an electromagnetic actuator.

14. An apparatus as defined by claim 11, wherein said means for providing reciprocating motion comprises a motor and a crank shaft coupled to the spool.

15. An apparatus as defined by claim 11, wherein the spool is made of a material having a low coefficient of friction.

16. An apparatus as defined by claim 11, wherein the work material is leather.

17. An apparatus for cutting for cutting a sheet-type work material, comprising:

a support surface mounted on a frame for carrying at least one layer of sheet-type work material thereon;

a carriage coupled to the frame for movement in various directions in response to commands issued from a controller;

a tool head mounted to the carriage and having a power tool and a guided pneumatic cylinder cutting head, the tool head being movable in various directions in response to commands from the controller, the power tool being able to engage and disengage with the work material in response to commands from the controller, the power tool comprising:

a cutting knife disposed in a tool holder;

a rod having a distal end and proximal end, and a spool;

the proximal end being attached to the spool, and the distal end being attached to the tool holder;

a bushing disposed between the knife and the spool for permitting rotary and linear motion of the knife;

means for providing reciprocating motion to the knife for cutting; and a servomotor having a drive shaft, a longitudinal axis of said shaft coaxially attached to the spool for orientating the direction of the knife in response to commands issued from a controller.

18. An apparatus as defined by claim 17, wherein the servomotor controls the orientation of the knife in a cutting path.

19. An apparatus as defined in claim 17, further including a housing having means for adjusting the cutting depth of the knife.

20. An apparatus for cutting pattern pieces and creating apertures in sheet-type work material, comprising:

a frame;

a support surface mounted on said frame for carrying at least one layer of sheet-type work material thereon;

a tool head mounted to the carriage and having a power tool and a guided pneumatic cylinder cutting head, the tool head being movable in various directions in response to commands from the controller, the power tool being able to engage and disengage with the work material in response to commands from the controller, the power tool comprising:

a cutting knife disposed in a tool holder;

a rod having a distal end and proximal end, and a spool;

the proximal end being attached to the spool, and the distal end being attached to the tool holder;

a bushing disposed between the knife and the spool for permitting rotary and linear motion of the knife;

a mass spring system actuated by an electromagnetic actuator; and a servomotor having a drive shaft, a longitudinal axis of said shaft coaxially attached to the spool for orientating the direction of the knife in response to commands issued from a controller.

* * * * *